US011769460B2

(12) United States Patent
Chan et al.

(10) Patent No.: US 11,769,460 B2
(45) Date of Patent: Sep. 26, 2023

(54) LOCAL DIMMING CONTROL WITH 2-LINE ADDRESSING

(71) Applicant: Solomon Systech (Shenzhen) Limited, Shenzhen (CN)

(72) Inventors: Wing Chi Stephen Chan, Hong Kong (CN); Ting On Ngan, Hong Kong (CN); Chi Wai Lee, Hong Kong (CN); Shu Shing Ching, Hong Kong (CN)

(73) Assignee: Solomon Systech (Shenzhen) Limited, Shenzhen (CN)

( * ) Notice: Subject to any disclaimer, the term of this patent is extended or adjusted under 35 U.S.C. 154(b) by 0 days.

(21) Appl. No.: 17/445,958

(22) Filed: Aug. 26, 2021

(65) Prior Publication Data

US 2023/0069665 A1 Mar. 2, 2023

(51) Int. Cl.
*G09G 3/34* (2006.01)
*G09G 3/36* (2006.01)

(52) U.S. Cl.
CPC ..... *G09G 3/3426* (2013.01); *G09G 3/36* (2013.01); *G09G 2320/0626* (2013.01); *G09G 2320/0686* (2013.01); *G09G 2330/021* (2013.01)

(58) Field of Classification Search
CPC .. G09G 3/2007; G09G 3/2014; G09G 3/2018; G09G 3/2092; G09G 3/2096; G09G 3/22; G09G 3/30; G09G 3/32; G09G 3/3216; G09G 3/3266; G09G 3/34; G09G 3/3406; G09G 3/342; G09G 3/3426; G09G 3/36; G09G 2310/0205; G09G 2310/0213; G09G 2310/0218; G09G 2310/0237; G09G 2310/024; G09G 2310/067; G09G 2310/08; G09G 2320/0285; G09G 2320/062; G09G 2320/0626; G09G 2320/064; G09G 2320/0646; G09G 2320/0686; G09G 2330/021; G09G 2330/025;

(Continued)

(56) References Cited

U.S. PATENT DOCUMENTS 11,315,503 B1 * 4/2022 Liu ..... G09G 3/36
2008/0284354 A1 * 11/2008 Chen ..... H05B 45/30 315/294

(Continued)

FOREIGN PATENT DOCUMENTS

DE 102018130240 * 6/2020 ..... G09G 3/20

*Primary Examiner* — Keith L Crawley
(74) *Attorney, Agent, or Firm* — S&F/WEHRW

(57) ABSTRACT

An image displaying apparatus with local dimming control with 2-line addressing is disclosed. The apparatus includes a display panel, a light-emitting diode (LED) backlight divided into a plurality of zones, and a control unit. The control unit is configured to couple a dimming data to the LED backlight. The zones of the LED backlight are driven by row enable signals and column driving signals based on the dimming data. Each individual column driving signal transmits a common brightness data, a first residual brightness data, and a second residual brightness data. A first row enable signal has a first enable pulse in a frame period, and a second row enable signal has a second enable pulse in the frame period. The first and second enable pulses are at least partially overlapped for reducing a pulse current of the LED backlight for enhancing a lifetime of the LED backlight.

15 Claims, 8 Drawing Sheets

(58) Field of Classification Search
CPC ..... G09G 2360/16; G02F 1/133601; G02F 1/133603; G02F 1/133613
See application file for complete search history.

(56) References Cited

U.S. PATENT DOCUMENTS

2010/0134522 A1* 6/2010 De Rijck ..... G09G 3/3426 345/690
2010/0277512 A1* 11/2010 Shen ..... G09G 3/2025 345/690
2012/0026214 A1* 2/2012 Oke ..... G09G 3/342 345/690
2012/0105441 A1* 5/2012 Park ..... G09G 3/342 345/694
2012/0162289 A1* 6/2012 Oniki ..... G09G 3/342 345/690
2013/0278651 A1* 10/2013 Yamamura ..... G09G 3/36 345/691
2014/0167630 A1* 6/2014 Lin ..... H05B 45/3725 315/186
2014/0267445 A1* 9/2014 Yaras ..... G09G 3/2037 345/690
2020/0117050 A1* 4/2020 Shao ..... G09G 3/3611

* cited by examiner

| | | | | | |
|---|---|---|---|---|---|
| 124 | 178 | 174 | 182 | 182 | 178 |
| 124 | 162 | 166 | 174 | 170 | 170 |
| 113 | 142 | 158 | 146 | 154 | 158 |
| 99 | 110 | 154 | 162 | 195 | 170 |
| 113 | 113 | 116 | 136 | 146 | 136 |
| 162 | 125 | 125 | 106 | 116 | 102 |
FIG. 6A
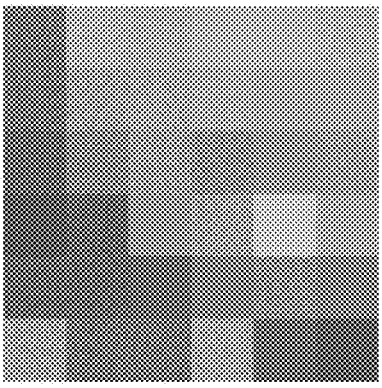
FIG. 6B
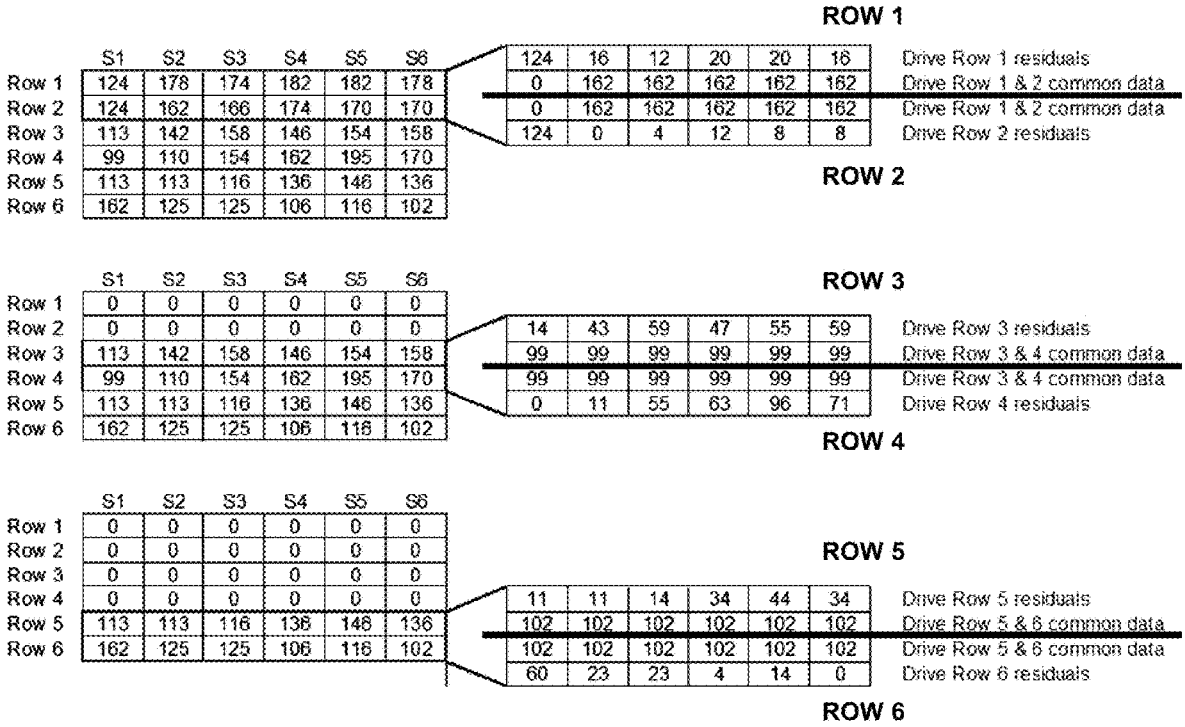
FIG. 7

| | | | | | |
|---|---|---|---|---|---|
| 16 | 122 | 136 | 136 | 136 | 16 |
| 54 | 122 | 174 | 195 | 136 | 16 |
| 113 | 122 | 136 | 195 | 173 | 173 |
| 113 | 162 | 136 | 178 | 247 | 231 |
| 113 | 113 | 124 | 173 | 231 | 215 |
| 16 | 16 | 96 | 162 | 162 | 162 |
FIG. 8A
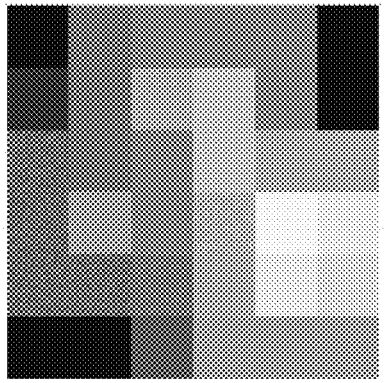
FIG. 8B
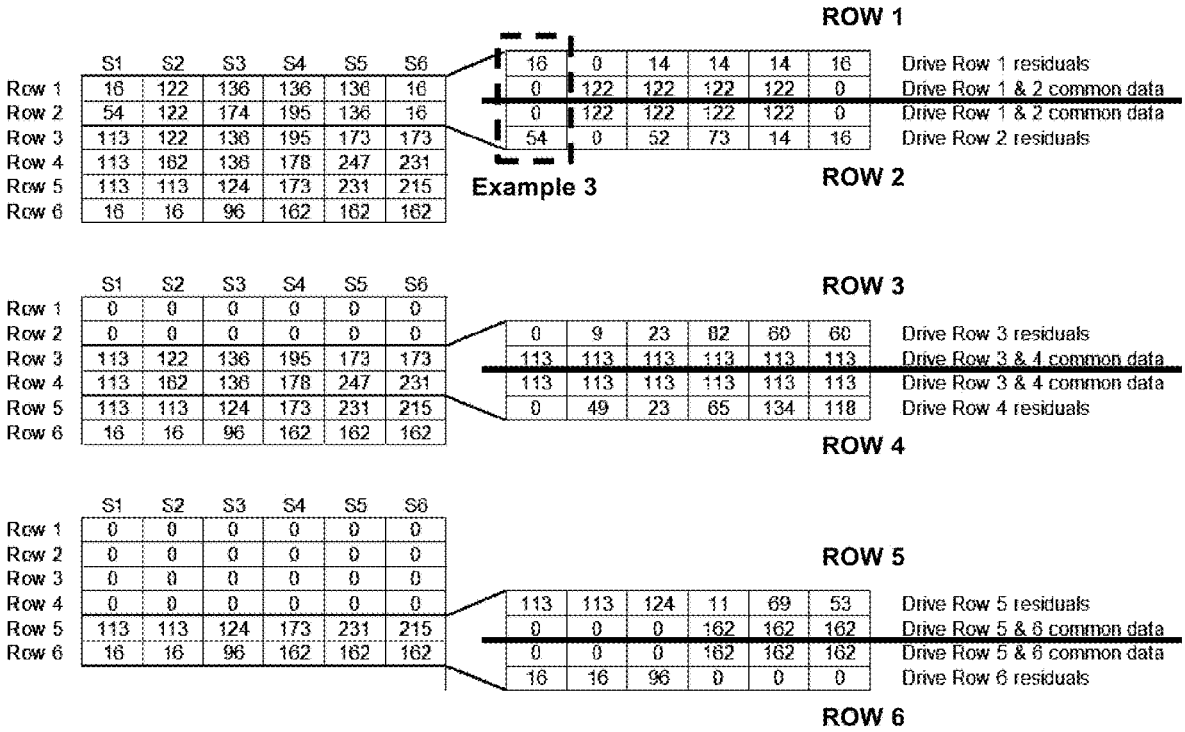
FIG. 9

LOCAL DIMMING CONTROL WITH 2-LINE ADDRESSING

FIELD OF THE INVENTION

The present invention is generally related to dimming control. In particular, the present invention relates to an image displaying apparatus having a light-emitting diode (LED) backlight divided into a plurality of zones of light sources arranged in a two-dimensional (2D) array for supporting local dimming or brightness control of a display panel.

BACKGROUND OF THE INVENTION

Local dimming is commonly used in an LED backlight system that is configured to perform regional control of backlight illumination and dimming for local display regions or blocks of a display panel. For example, the local dimming can be implemented in a liquid crystal display (LCD) with an LED backlight system. The LED backlight system is configured into a plurality of local regions or blocks, and positioned behind the LCD for illuminating the corresponding local display regions on the LCD. The local dimming allows brightness control of each local display region independently without applying the same brightness condition across the entire display. Hence, LCD with a local dimming backlight system has been recognized as a display with enhanced dynamic range and reduced overall power consumption.

FIG. 1 shows a possible display apparatus with local dimming control. The system includes an LCD panel 10 and an LED backlight 20. The LCD panel 10 is driven by a display driver 11, while the LED backlight 20 is preferably a mini-LED (mLED) backlight divided into 36 zones 23 arranged in a 2D array, each comprising an array of LEDs 22. The LED backlight 20 is driven by LED driver 21. The LCD panel 10 and the LED backlight 20 are controlled by a local dimming bridge chip 30. Video data from the application processor 40 is first being analyzed by the local dimming bridge chip 30, then the local dimming bridge chip 30 couples dimming data to the LED driver 21, and compensated video data to the display driver 11. For darker regions, the corresponding zones 23 on the LED backlight 20 are set dimmer. For brighter regions, the corresponding zones 23 on the LED backlight 20 are set brighter. The video data is compensated or scaled to match with the LED backlight 20 for driving the LCD panel 10.

The LED backlight 20 is generally realized as a passive matrix, which is particularly preferred for a 2D array of LEDs with not more than 1000 zones 23. In case there are more than 1000 zones 23, it is preferred to realize as an active matrix. In general, the backlight system in the passive matrix has a higher power efficiency and lower cost, however, limited by the number of scan rows. When the number of scan rows is too large, e.g., 40 or more rows, the pulse current would be increased. When the pulse current is too high, the passive matrix becomes infeasible and the backlight system can only be realized in an active matrix.

High pulse current is detrimental to the lifespan of the LEDs. Normally, a pulse current of not more than 30 times of the rated DC forward current of an LED with a low pulse duty cycle is preferred. For example, the pulse width is within a millisecond for a 2% pulse duty cycle. For a 2D backlight system having 30 scan rows, the time multiplexing would be 30 and the pulse current would be at least 30 times higher than the target continuous current. Hence, there is a limitation on the maximum number of scan rows in a passive matrix backlight system.

Accordingly, there is a need in the art for a driving scheme that seeks to address at least some of the above problems in a passive matrix LED backlight system. Furthermore, other desirable features and characteristics will become apparent from the subsequent detailed description and the appended claims, taken in conjunction with the accompanying drawings and this background of the disclosure.

SUMMARY OF THE INVENTION

In the light of the foregoing background, it is an objective of the present disclosure to provide a backlight system having plural LEDs arranged in a 2D array with 2-line addressing for supporting local dimming or brightness control of a display panel. The above object is met by the combination of features of the main claim; the sub-claims disclose further advantageous embodiments of the invention.

In accordance with a first aspect of the present invention, there is provided an apparatus for displaying images. The apparatus comprises a display panel comprising plural pixels for displaying the images; an LED backlight divided into a plurality of zones arranged in a 2D array of rows and columns; and a control unit configured to couple a compensated video data to the display panel and a dimming data to the LED backlight. The plurality of zones of the LED backlight are driven by row enable signals and column driving signals based on the dimming data. Each individual column driving signal transmits a common brightness data, a first residual brightness data, and a second residual brightness data. A first row enable signal comprises a first enable pulse in a frame period, and a second row enable signal comprises a second enable pulse in the frame period, wherein the first enable pulse and the second enable pulse are at least partially overlapped for reducing a pulse current of the LED backlight as compared with an arrangement without overlapping, thereby enabling a lifetime of the LED backlight to be enhanced.

In an embodiment of the first aspect, the common brightness data is applied to two rows of zones. The first residual brightness data is applied to a first row of the two rows of zones. The second residual brightness data is applied to a second row of the two rows of zones.

In an embodiment of the first aspect, the first row emits light according to the first residual brightness data and the common brightness data; and the second row emits light according to the second residual brightness data and the common brightness data.

Preferably, the first row is adjacent to the second row.

In an embodiment of the first aspect, the first enable pulse has a first pulse width comprising a first pulse width portion and an overlapping pulse width portion. The second enable pulse has a second pulse width comprising a second pulse width portion and the overlapping pulse width portion.

In an embodiment of the first aspect, the first pulse width portion is immediately before the overlapping pulse width portion; and the second pulse width portion is immediately after the overlapping pulse width portion.

In an embodiment of the first aspect, the two rows of zones are enabled simultaneously according to the common brightness data during the overlapping pulse width portion.

In an embodiment of the first aspect, the first row is enabled according to the first residual brightness data during the first pulse width portion of the first pulse width; and the second row is enabled according to the second residual brightness data during the second pulse width portion of the second pulse width.

In an embodiment of the first aspect, the LED backlight is driven by an LED driver configured to receive the dimming data and couple the row enable signals and the column driving signals to the LED backlight.

In an embodiment of the first aspect, the common brightness data is adaptively selected from a plurality of predetermined comparison values for determining an optimized value for the common brightness data to achieve a largest total brightness data on the overlapping pulse width portion across all the zones on the first row and the second row.

In an embodiment of the first aspect, the LED driver comprises a plurality of accumulator blocks each configured to perform data accumulation for a comparison value, thereby the comparison value achieving the largest total brightness data is determined In an embodiment of the first aspect, an individual accumulator block comprises a comparator and an adder, wherein the comparator is configured to receive common brightness factors from the column, and couple a value equivalent to the comparison value to the adder when the receive common brightness factor is larger than the comparison value.

In an embodiment of the first aspect, the control unit is integrated into the LED driver or a display driver configured to drive the display panel.

In certain embodiments, the display panel is a LCD panel.

In certain embodiments, the control unit is a local dimming bridge chip configured to receive a video data from an application processor.

In accordance with a second aspect of the present invention, there is provided an LED backlight for a display panel. The LED backlight comprises plural LEDs arranged in a plurality of zones, wherein the plurality of zones are arranged in a two-dimensional (2D) array of rows and columns; and an LED driver configured to receive a dimming data from a control unit and couple row enable signals and column driving signals to drive the plurality of zones based on the dimming data. each individual column driving signal transmits a common brightness data, a first residual brightness data, and a second residual brightness data. A first row enable signal comprises a first enable pulse in a frame period, and a second row enable signal comprises a second enable pulse in the frame period, wherein the first enable pulse and the second enable pulse are at least partially overlapped for reducing a pulse current of the LED backlight as compared with an arrangement without overlapping, thereby enabling a lifetime of the LED backlight to be enhanced.

In an embodiment of the second aspect, the common brightness data is applied to two rows of zones. The first residual brightness data is applied to a first row of the two rows of zones. The second residual brightness data is applied to a second row of the two rows of zones.

In an embodiment of the second aspect, the first enable pulse has a first pulse width comprising a first pulse width portion and an overlapping pulse width portion. The second enable pulse has a second pulse width comprising a second pulse width portion and the overlapping pulse width portion.

In an embodiment of the second aspect, the first pulse width portion is immediately before the overlapping pulse width portion; and the second pulse width portion is immediately after the overlapping pulse width portion.

In an embodiment of the second aspect, the common brightness data is adaptively selected from a plurality of predetermined comparison values for identifying an optimized value for the common brightness data to achieve a largest total brightness data on the overlapping pulse width portion across all the zones on the first row and the second row.

This Summary is provided to introduce a selection of concepts in simplified forms that are further described below in the Detailed Description. This Summary is not intended to identify key features or essential features of the claimed subject matter, nor is it intended to be used as an aid in determining the scope of the claimed subject matter. Other aspects and advantages of the present invention are disclosed as illustrated by the embodiments hereinafter.

BRIEF DESCRIPTION OF THE DRAWINGS

The appended drawings contain figures to further illustrate and clarify the above and other aspects, advantages, and features of the present disclosure. It will be appreciated that these drawings depict only certain embodiments of the present disclosure and are not intended to limit its scope. It will also be appreciated that these drawings are illustrated for simplicity and clarity and have not necessarily been depicted to scale. The present disclosure will now be described and explained with additional specificity and detail through the use of the accompanying drawings in which:

FIG. 6A depicts an exemplary brightness data for the zones of an LED backlight;

FIG. 6B depicts the perceived brightness of the zones of the LED backlight based on the exemplary brightness data of FIG. 6A;

FIG. 7 depicts the residual brightness data and the common brightness data for each row of zones using 2-line addressing local dimming based on the exemplary brightness data of FIG. 6A;

FIG. 8A depicts a second exemplary brightness data for the zones of an LED backlight;

FIG. 8B depicts the perceived brightness of the zones of an LED backlight based on the exemplary brightness data of FIG. 8A;

FIG. 9 depicts the residual brightness data and the common brightness data for each row of zones using 2-line addressing local dimming based on the exemplary brightness data of FIG. 8A;

DETAILED DESCRIPTION OF THE INVENTION

Figure 1:
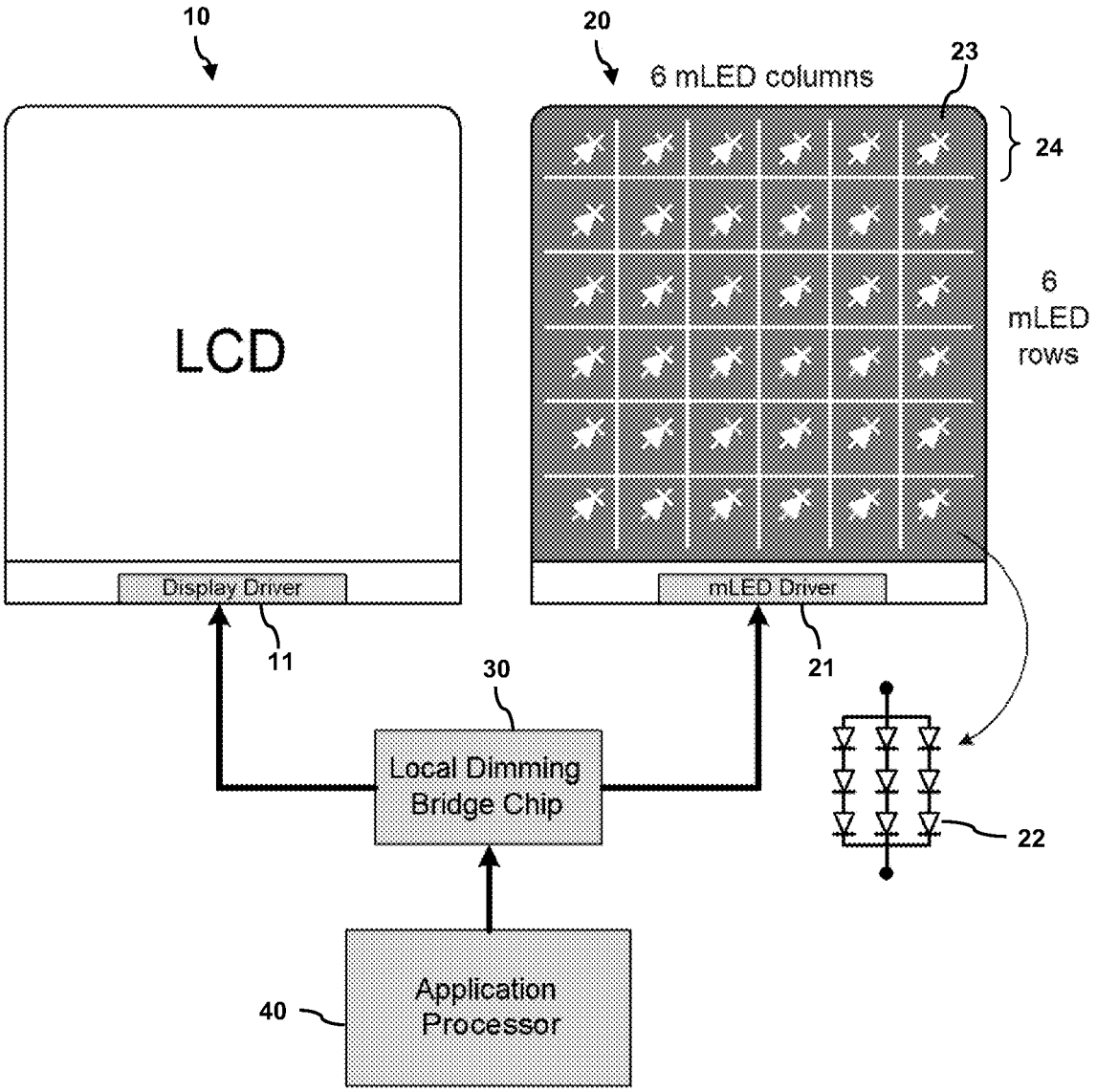
FIG. 1 (Prior Art)
FIG. 1 depicts a possible display apparatus with local dimming control.

The present disclosure generally relates to a backlight system having plural LEDs arranged in a 2D array with 2-line addressing for supporting local dimming or brightness control of a display panel. More specifically, but without limitation, the 2-line addressing driving scheme of the present disclosure can be deployed to a passive matrix backlight system to at least partially relax the limitation with respect to the high pulse current.

The following detailed description is merely exemplary in nature and is not intended to limit the disclosure or its application and/or uses. It should be appreciated that a vast number of variations exist. The detailed description will enable those of ordinary skilled in the art to implement an exemplary embodiment of the present disclosure without undue experimentation, and it is understood that various changes or modifications may be made in the function and structure described in the exemplary embodiment without departing from the scope of the present disclosure as set forth in the appended claims.

Some portions of the description which follows are explicitly or implicitly presented in terms of algorithms and functional or symbolic representations of operations on data within a computer memory. These algorithmic descriptions and functional or symbolic representations are the means used by those skilled in the data processing arts to convey most effectively the substance of their work to others skilled in the art. An algorithm is here, and generally, conceived to be a self-consistent sequence of steps leading to the desired result. The steps are those requiring physical manipulations of physical quantities, such as electrical, magnetic, or optical signals capable of being stored, transferred, combined, compared, and otherwise manipulated.

The benefits, advantages, solutions to problems, and any element(s) that may cause any benefit, advantage, or solution to occur or become more pronounced are not to be construed as critical, required, or essential features or elements of any or all of the claims. The invention is defined solely by the appended claims including any amendments made during the pendency of this application and all equivalents of those claims as issued.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The use of any and all examples, or exemplary language (e.g., "such as") provided herein, is intended merely to illuminate the invention better and does not pose a limitation on the scope of the invention unless otherwise claimed. No language in the specification should be construed as indicating any non-claimed element as essential to the practice of the invention.

The terminology used herein is for the purpose of describing particular embodiments only and is not intended to be limiting of the described technology. As used herein, the term "display panel" can be an LCD, a flexible display, or other display devices comprised of a plurality of pixels that are capable of displaying images and/or video. The term "frame" as used herein refers to the time period of one complete screen refresh cycle of the display panel, including the time for updating the pixels on the display panel and the time for activating the backlight. The term "LED" and "mLED", and the like are used interchangeably as the backlight for the display panel.

Local Dimming with 2-Line Addressing

According to the embodiments described in FIG. 1, an apparatus for display image comprising an LCD panel 10, an LED backlight 20 for backlight generation, and a local dimming bridge chip 30 is provided. The LCD panel 10 is driven by a display driver 11, while the LED backlight 20 is divided into a plurality of zones 23 arranged in a 2D array of rows and columns, wherein each zone 23 comprises a plurality of LED 22. The LED backlight 20 is driven by LED driver 21. The LCD panel 10 and the LED backlight 20 are controlled by a local dimming bridge chip 30. The zones 23 are not enabled simultaneously. In a preferred implementation, the zones 23 are enabled row by row. Each row of zones 24 is activated to emit light at a particular time period, and another row of zones 24 is activated to emit light sequentially until all the zones 23 of the LED backlight 20 are enabled once.

Figure 2A:
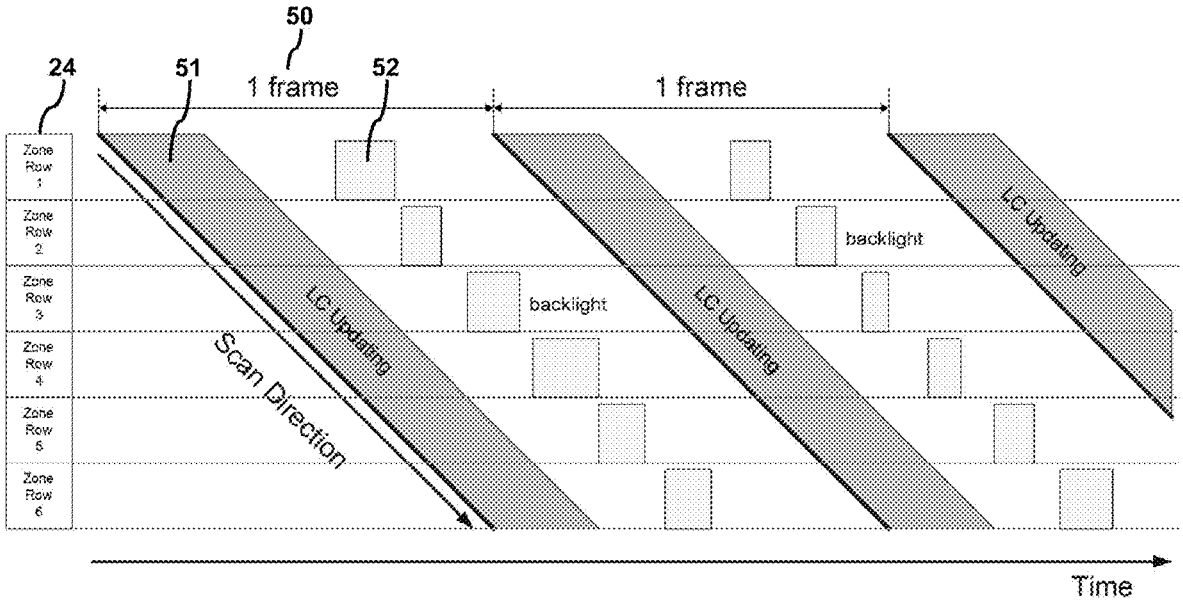
FIG. 2A (Prior Art)
FIG. 2A depicts a typical timing diagram showing the source current for implementing a conventional local dimming in a display system.
Figure 2B:
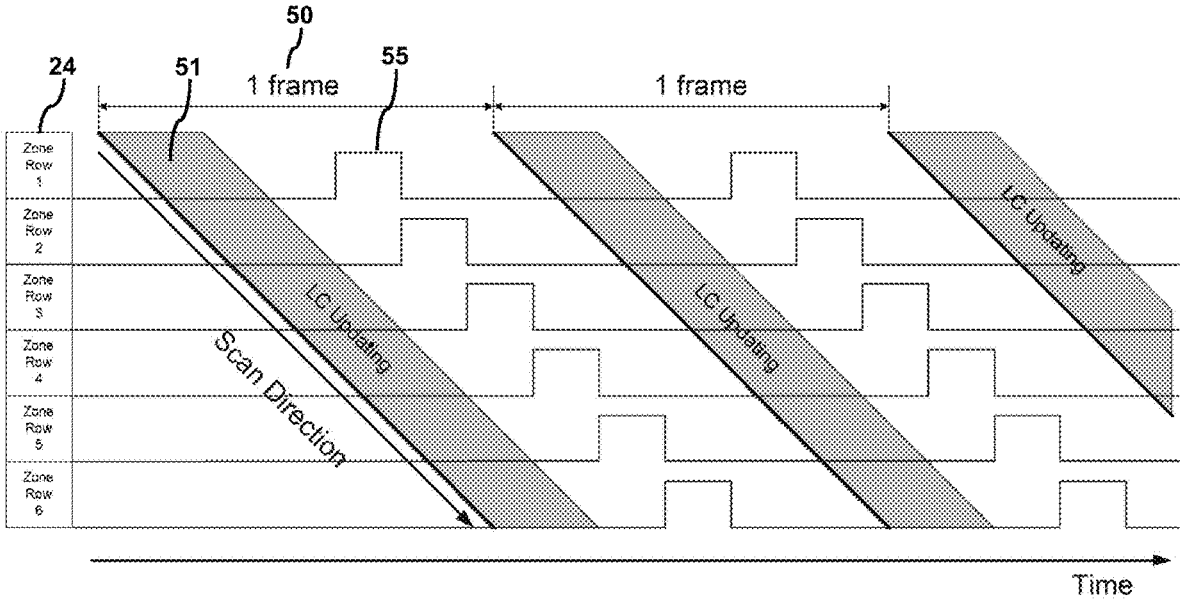
FIG. 2B (Prior Art)
FIG. 2B depicts a typical timing diagram showing the row enable signal for implementing a conventional local dimming in a display system.

FIG. 2A shows a typical timing diagram showing the source current for implementing a conventional local dimming using 1-line addressing in a display system, while FIG. 2B correspondingly shows a typical timing diagram of the row enable signal. In the illustrated embodiments, 6 rows of zones 24 are shown for clarity and simplicity. It is apparent that the number of rows of zones 24 may be otherwise without departing from the scope and spirit of the present disclosure. For each frame 50, the time period is divided into two parts. The first part 51 of the frame 50 is allocated for updating the liquid crystal (LC) by sending signals to the LCD panel 10. LC is a relatively slow switching material, which takes some time to twist to a new angle after the application of a new voltage level. During this period of the first part 51 for updating the LC, the corresponding zones 23 of the LED backlight 20 should not be enabled, with a sufficient time for the data to get stable. If not, motion blur will be observed, particularly for fast-moving images. The second part 52 of the frame 50 is allocated for enabling the LED backlight 20 based on the dimming data. There are six rows of zones 24 in the example, and so there are six pulses in a frame. The corresponding row enable signals are shown in FIG. 2B. The enable pulses 55 for the row of zones 24 are provided without overlapping. Normally, the pulse widths of the enable pulses 55 are consistent. On the same row, different zone 23 may have different brightness. The pulse width for activating each zone 23 is further adjustable based on the required brightness of said zone 23. Preferably, the brightness for a zone 23 is controlled by pulse width modulation (PWM). The timing is controlled by the dimming data and should not overlap with the corresponding timing of the first part 51 for updating the LC. The rows of zones 24 are not enabled simultaneously to avoid the current surge. In certain embodiments, the zones 23 are controlled sequentially along the scan direction and repeat again in the next frame 50. With the 1-line control of the zones 23, the LED driving current is always a constant. The varying factor is the duration of enabling the zone 23.

Figure 3:
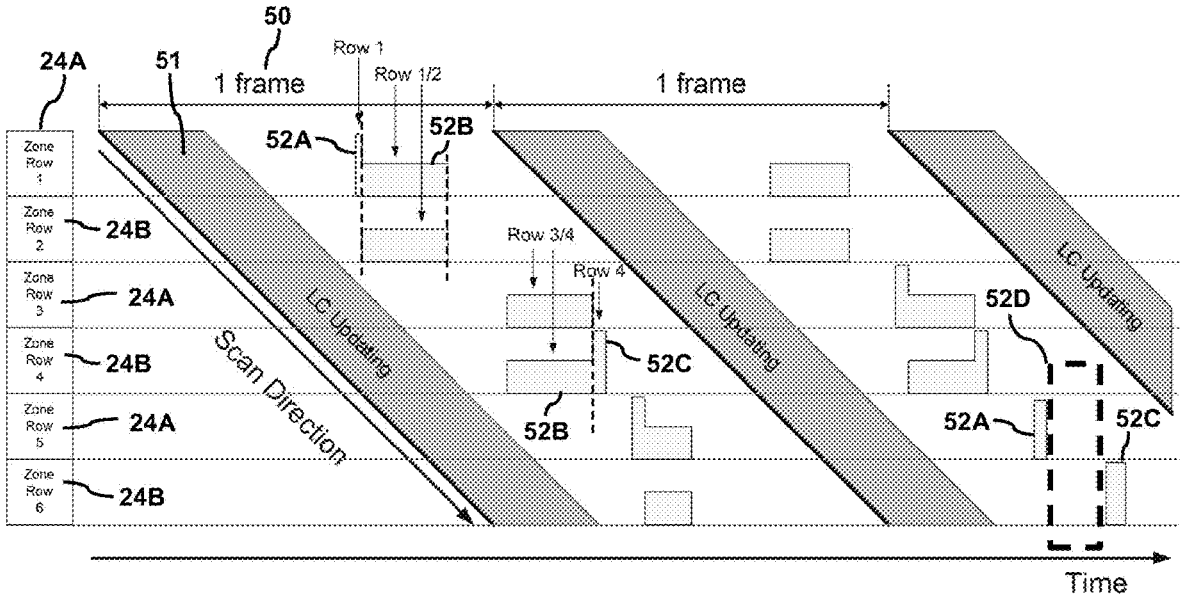
FIG. 3 depicts an exemplary timing diagram showing the column driving signal of each zone for implementing 2-line addressing local dimming in a display system, in accordance with certain embodiments of the present disclosure.

FIG. 3 illustrates an exemplary timing diagram showing the column driving signals of each row for implementing local dimming with 2-line addressing in a display apparatus in accordance with certain embodiments of the present disclosure. Similar to the conventional architecture described in FIG. 1, the display apparatus comprises a display panel, such as an LCD panel 10, having plural pixels for display images; an LED backlight 20; and a control unit configured to dynamically control the display panel and the LED backlight 20, and to couple a compensated video data to the display panel and a dimming data to the LED backlight 20. The LED backlight 20 is divided into a plurality of zones 23 of light sources arranged in a 2D array of rows and columns, wherein each zone 23 comprises a plurality of LED 22. The LED backlight 20 is driven by LED driver 21 configured to receive the dimming data. For each frame 50, the time period is divided into two parts. The first part 51 of the frame 50 is allocated for updating the LC by sending signals to the LCD panel 10, while the second part 52 is allocated for enabling the LED backlight 20 based on the dimming data. For each row of pixels on the LCD panel 10, the update of the LC is performed row by row along the scan direction. Hence, the LED backlight 20 is also driven sequentially row by row outside the time intervals for updating the LC (i.e. the first part 51). The plurality of zones 23 of the LED backlight 20 are driven by row enable signals and column driving signals based on the dimming data, which are coupled from the LED driver 21 after receiving the dimming data from the control unit. Preferably, the control unit is a local dimming bridge chip configured to receive a video data from an application processor 40. Alternatively, the control unit is integrated into the LED driver 21 or the display driver 11 as a single integrated circuit chip, configured to receive a video data from an application processor 40.

As illustrated, two rows of zones are driven together for adjusting the brightness of the LEDs according to the local brightness data of each zone 23. For simplicity and clarity, the first row 24A is adjacent to the second row 24B. It is apparent that the first row 24A and the second row 24B may otherwise be any row of zones 24 of the LED backlight 20 without departing from the scope and spirit of the present disclosure. The first row 24A and the second row 24B of the two rows of zones have similar column driving signals. The two rows of zones are driven approximately simultaneously but not exactly in the same manner. The time period for enabling the first row 24A and the second row 24B of the two zones are partially overlapped, while the first row 24A of zones may be enabled earlier than the second row 24B, and the second row 24B may continue to enable after the overlapping period. This demonstrates the distinguishing feature of the 2-line addressing that the first row 24A and second row 24B have an overlapping period for emitting light at the same time with the same intensity. Any difference between the brightness of the first row 24A and the second row 24B is handled by controlling the time periods of enabling the first row 24A before the overlapping period and the time period of enabling the second row 24B after the overlapping period. Each row of zone 24 is still be driven once per frame 50, such that the errors due to charging and discharging the source lines can be minimized. Such errors with regard to the charging and discharging of the source lines are more serious and detrimental to the overall performance in passive-matrix organic light-emitting diode (PMOLED) display.

Particularly, the PMOLED display typically has more than 100 rows while the LED backlight usually has 10 to 30 rows only. In addition, the source lines of PMOLED are transparent conductive film, such as indium tin oxide (ITO), which has a much higher resistance than the source lines of LED backlight, which are copper traces on printed circuit board (PCB).

In certain embodiments, each individual column driving signal transmits a common brightness data 52B, a first residual brightness data 52A, and a second residual brightness data 52C to the LED backlight 20 for driving two rows of zones along said column. The common brightness data 52B is applied to the two rows of zones during the overlapping period. Before the overlapping period, the first residual brightness data 52A is applied to the first row 24A. Therefore the first row 24A emits light according to the first residual brightness data 52A and the common brightness data 52B. After the overlapping period, the second residual brightness data 52C is applied to the second row 24B. Therefore the second row 24B emits light according to the second residual brightness data 52C and the common brightness data 52B. It should also be noted that the first residual brightness data 52A and the second residual brightness data 52C may be zero if the target brightness of the zone is exactly the same as the common brightness data 52B. This case is illustrated in the second row of zones. It should also be noted that the common brightness data 52B can be set to zero (labeled as 52D). This generally happens when at least one of the two rows of zones has a small brightness data. When the row is driving by the first or second residual data 52A, 52C, the LED driving current is not shared by two lines and so the current is substantially higher than the overlapping period where the two rows are driven by the common brightness data 52B.

Figure 4:
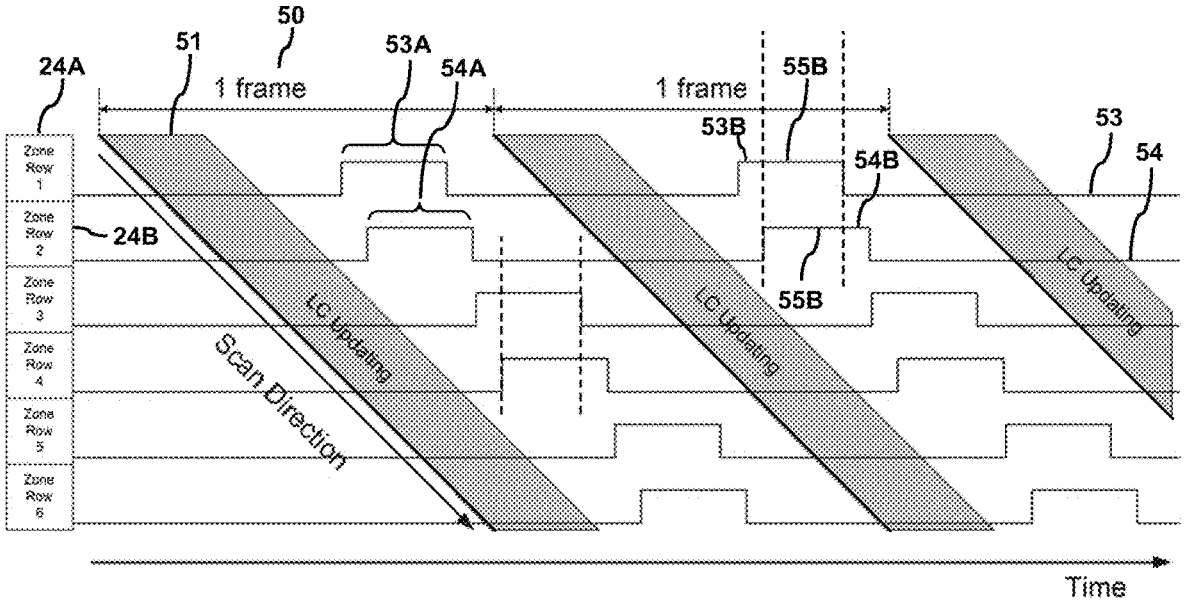
FIG. 4 depicts an exemplary timing diagram showing the row enable signal for implementing 2-line addressing local dimming in a display system, in accordance with certain embodiments of the present disclosure.

FIG. 4 provides an exemplary timing diagram showing the row enable signal for implementing 2-line addressing local dimming in a display system. The row enable signal is provided to each row of zones 24 for enabling the zone to receive the column driving signals. In certain embodiments, the row enable signals are independent of the brightness data. However, it is also possible to have the row enable signals adjustable according to the required brightness. A first row enable signal 53 is provided for the first row 24A, and a second row enable signal 54 is provided for the second row 24B. The first row enable signal 53 comprises a first enable pulse 53A in a frame period 50, and the second row enable signal 54 comprises a second enable pulse 54A in the same frame period 50. The first and second enable pulses 53A, 54A are repeated again in the next frame 50 and onwards. The first enable pulse 53A and the second enable pulse 54A are at least partially overlapped. As the LED driving current across the pixels is generally lower during the overlapped time period, the configuration of having the first and second enable pulses 53A, 54A can effectively reduce the pulse current of the LED backlight 20 as compared with an arrangement of the backlight using conventional local dimming without overlapping. Therefore, the high pulse current is less serious, which enables a lifetime of the LED backlight 20 to be improved. The improvement is particularly obvious for PMOLED applications.

The details of the first and second enable pulses 53A, 54A are further explained below. The first enable pulse 53A has a first pulse width comprising a first pulse width portion 53B and an overlapping pulse width portion 55B. The first pulse width portion 53B is immediately before the overlapping pulse width portion 55B. Similarly, the second enable pulse 54A has a second pulse width comprising a second pulse width portion 54B and the overlapping pulse width portion 55B. The second pulse width portion 54B is immediately after the overlapping pulse width portion 55B. As explained in FIG. 3, the two rows of zones are enabled simultaneously according to the common brightness data 52B during the overlapping pulse width portion 55B. The first row 24A is enabled according to the first residual brightness data 52A during the first pulse width portion 53B of the first pulse width. The second row 24B is enabled according to the second residual brightness data 52C during the second pulse width portion 54B of the second pulse width. In the examples of the present disclosure, the first and second enable pulses 53A, 54A are active high. However, in some cases, the first and second enable pulses 53A, 54A may be active low.

Figure 5:
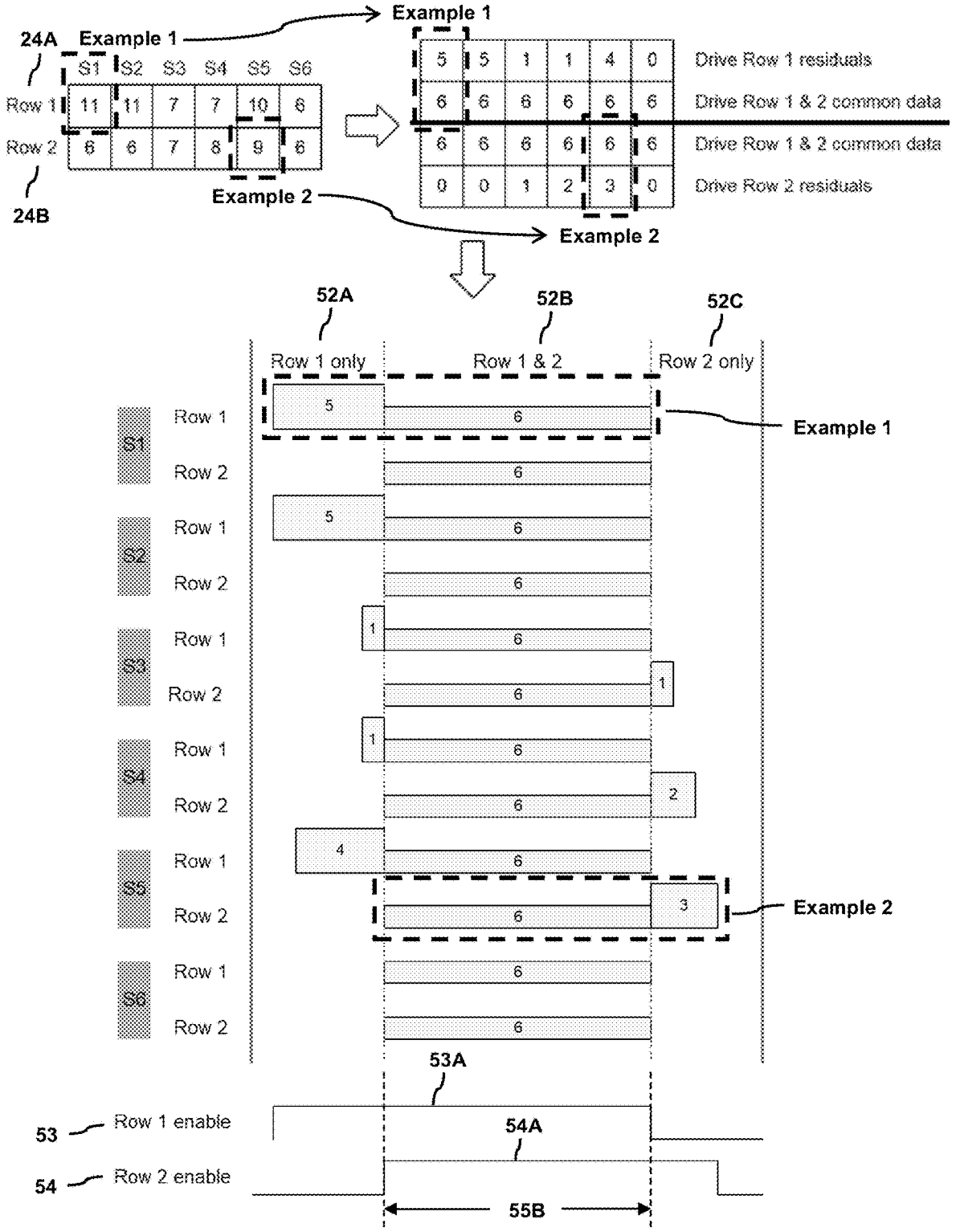
FIG. 5 depicts the breakdown of the common brightness data and the residual brightness data, in accordance with certain embodiments of the present disclosure.

With reference to the example shown in FIG. 5, the LED backlight 20 is divided into 12 zones arranged in a 2×6 array of rows and columns. The 6 columns may be referred to as "source column" sequentially listed as "S1", "S2" . . . , and "S6", which are individually controlled by 6 column driving signals. Two row enables signals 53, 54 and six column driving signals are used to drive these 12 zones each with local brightness data. The local brightness data for each zone is exemplarily shown in the figure. By applying 2-line addressing, each brightness data can be divided into a residual data and a common brightness data. The common brightness data 52B used in this example is "6", which is consistently applied to the two rows of zones. Refer to example 1 in the illustration, the local brightness data is "11" (row 1, S1), which can be divided into a common brightness data 52B of "6" and a first residual data 52A of "5". Similarly, the example 2 has a brightness data of "9" (row 2, S5), which can be divided into a common brightness data 52B of "6" and a second residual data 52C of "3". The driving current for the LED backlight 20 is constant, so the adjustment of brightness as defined by the common brightness data 52B, the first and the second residual data 52A, 52C is controlled by pulse width modulation.

The first pulse width portion 53A and the second pulse width portion 54A are partially overlapped to provide the overlapping pulse width portion 55B for enabling the LEDs in two rows of zones according to the common brightness data 52B (i.e. "6"). The first pulse width portion 53A is further enabled immediately before the overlapping pulse width portion 55B for enabling the LEDs in the first row of zones according to the first residual data 52A (i.e. "5" for example 1). The second pulse width portion 54A is on the other hand enabled immediately after the overlapping pulse width portion 55B for enabling the LEDs in the second row of zones according to the second residual data 52C (i.e. "3" for example 2).

FIG. 6A shows an exemplary brightness data for the zones of an LED backlight 20 with a 6×6 array of zones. FIG. 6B shows the corresponding perceived brightness of the zones of the LED backlight. In order to realize the 2-line addressing in the dimming control, two adjacent rows of zones are paired up. As demonstrated in FIG. 7, row 1 and row 2 are paired up with a first common brightness data of 162. Similarly, row 3 and row 4 are paired up with a second common brightness data of 99. Row 5 and row 6 are paired up with a third common brightness data of 102. Each of the three common brightness data is adaptively selected based on the brightness data of the zones on the two corresponding rows. In many cases, the adjacent zones have similar local brightness data. The arrangement of the present disclosure examines the local brightness data of all the zones on the two rows together and determines an optimized value for the common brightness data 52B.

In some cases, the adjacent zones may have a larger zone-to-zone deviation in local brightness data. As exemplarily illustrated in FIG. 8A and FIG. 8B, the brightness data for the zones of an LED backlight 20 vary greater along the same row. This is also shown in the corresponding perceived brightness. The common brightness data is an optimized value adaptively selected based on the brightness data of the zones on the two corresponding rows, as shown in FIG. 9. If the local brightness data of a zone is less than the optimized value, the common brightness data for that particular source column is set to 0 instead. This is demonstrated in example 3. Either one of the local brightness data on the two rows along the same source column is less than the optimized value, the brightness data is equal to the residual data, while the common brightness data is 0.

Determining the Common Brightness Data

Figure 10:
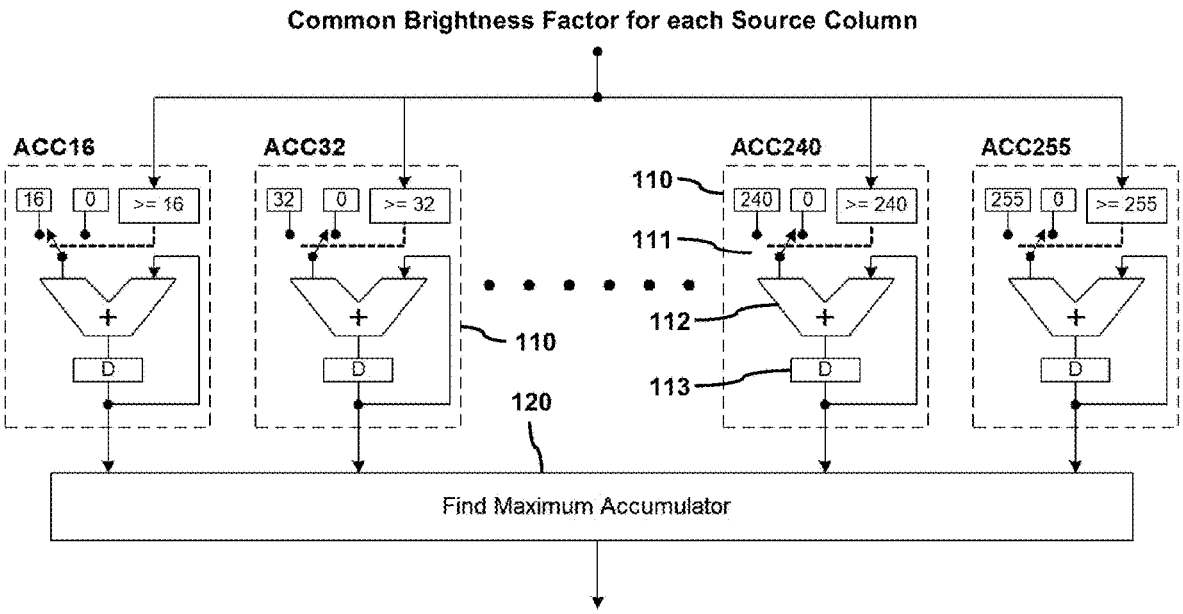
FIG. 10 depicts a schematic diagram of the logic circuit for calculating the common brightness data for 2-line addressing, in accordance with certain embodiments of the present disclosure.

Another aspect of the present disclosure provides the method and the logic circuit for determining the common brightness data 52B, which shall be used on two rows of zones. The common brightness data 52B is adaptively selected from a plurality of predetermined comparison values for determining an optimized value for the common brightness data 52B to achieve the largest total brightness data on the overlapping pulse width portion 55B across all the zones on the first row 24A and the second row 24B. FIG. 10 provides the logic circuit diagram for determining the common brightness data 52B. The logic circuit is configured to examine the local brightness data of all the zones on the two rows 24A, 24B and determines an optimized value for the common brightness data 52B. In certain embodiments, the common brightness data 52B is adaptively selected from 16 predetermined comparison values. The logic circuit has 16 accumulator blocks 110, each configured to perform data accumulation for a comparison value. The number of predetermined comparison values is not limiting and may be otherwise without departing from the scope and spirit of the present disclosure. If the number of predetermined comparison values is higher, the chip size of the LED driver 21 may be larger, but the performance in enhancing a lifetime of the LED backlight 20 is expected to be improved.

The purpose of having a plurality of accumulator blocks 110 is to determine which comparison value can achieve the largest total brightness data on the overlapping pulse width portion 55B across all the zones on the two rows. In the foregoing discussion, if the local brightness data of a zone is less than the optimized value, the common brightness data for that particular source column is set to 0. The accumulator block 110 is configured to calculate the sum of the brightness data on the overlapping pulse width portion 55B that are higher than the comparison value of the accumulator block 110.

Referring to the logic circuit, each individual accumulator block 110 comprises a comparator 111 and an adder 112. The comparator 111 is configured to receive common brightness factors for each source column from the two rows of zones 24. The comparator determines whether the received common brightness factor is larger than the comparison value. If it is larger than the comparison value, the comparator 111 will couple a value equivalent to the comparison value to the adder 112. If it is smaller than the comparison value, the comparator 111 will couple a zero value to the adder 112. After a delay 113, the evaluation is repeated for another source column of data on the two rows of zones 24 by receiving another common brightness factor. Upon evaluating all the source columns, the maximum accumulator 120 is determined by identifying the comparison value of the accumulator block 110 with the highest value summed up by the adder 112, which represents the largest total brightness data of the two rows of zones 24.

Figure 11:
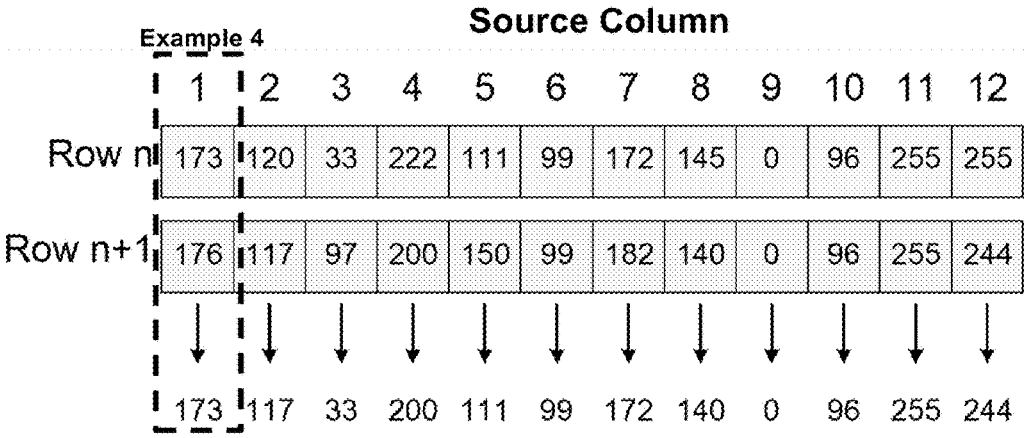
FIG. 11 depicts an exemplary determination of the common brightness factor.

FIG. 11 provides an example of the brightness data of two rows and the corresponding common brightness factor for each source column. With reference to the first source column, as highlighted in example 4, row n has a brightness data of "173" and row n+1 has a brightness data of "176". Therefore, the common brightness factor for coupling to the accumulator block 110 is "173", which is the smaller value of the two brightness data.

Figure 12:
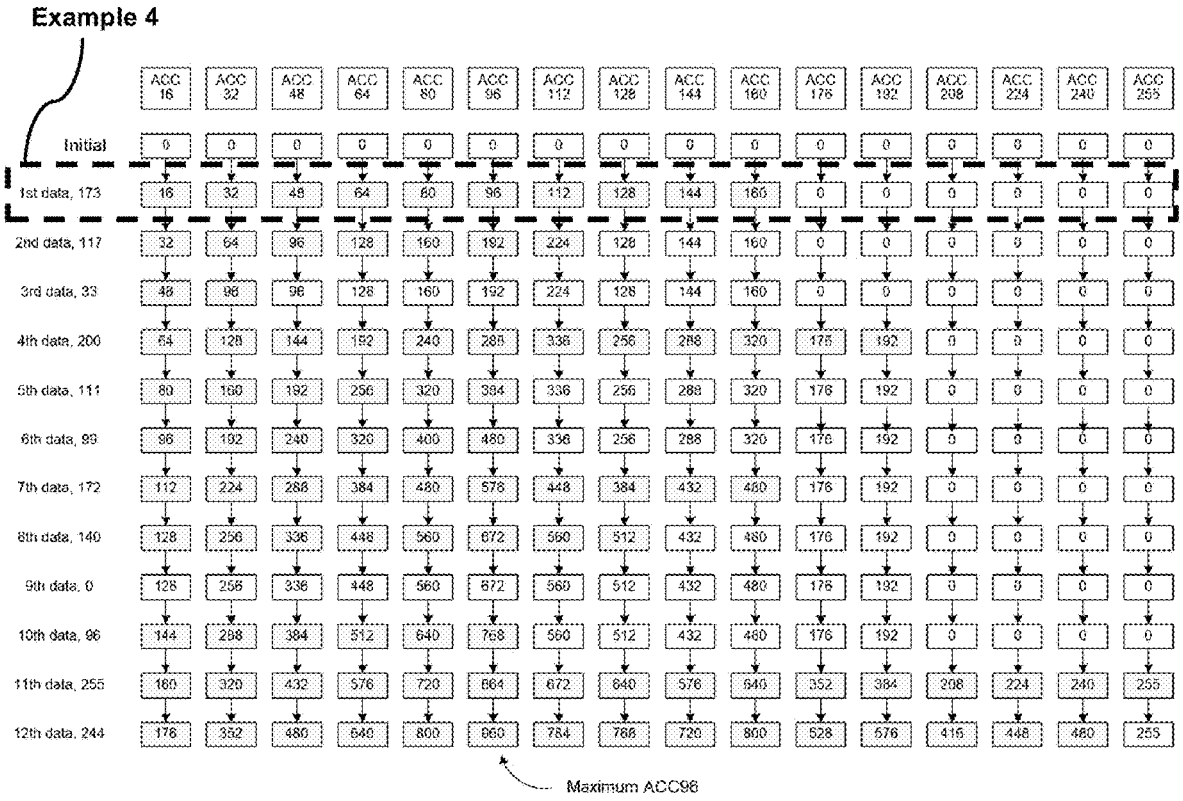
FIG. 12 depicts an exemplary calculation in the accumulator block for determining the comparison value achieving the largest total brightness data using the logic circuit of FIG. 10 and based on common brightness factor on FIG. 11.

FIG. 12 demonstrates the operation of the accumulator block 110 for determining the comparison value that can achieve the largest total brightness data of the two rows of zones 24. The accumulation is processed one by one for the source column. The accumulator block 110 is first set to zero initially. When the common brightness factor for the first source column is coupled to the accumulator block 110, the common brightness factor is compared by the comparator 111 with the comparison value. With reference to the case of 173 as highlighted as example 4, the common brightness factor is larger than the following comparison values: 16, 32, 48, 64, 80, 96, 112, 128, 144, and 160. Therefore, the corresponding accumulator blocks 110 perform summation of the comparison values by the adder 112. At the same time, the comparators 111 in the accumulator blocks 110 for comparison values of 176, 192, 208, 224, 240, and 255 couple a value of zero to the next stage as the comparison value is larger than the common brightness factor of that source column (i.e. 173). The comparison and accumulation process is repeated until all the source columns are evaluated. The maximum value accumulated is determined. In the illustrated embodiment, the accumulator block 110 with the largest total brightness data is ACC96, which is the accumulator block 110 with a comparison value of 96.

Figure 13:
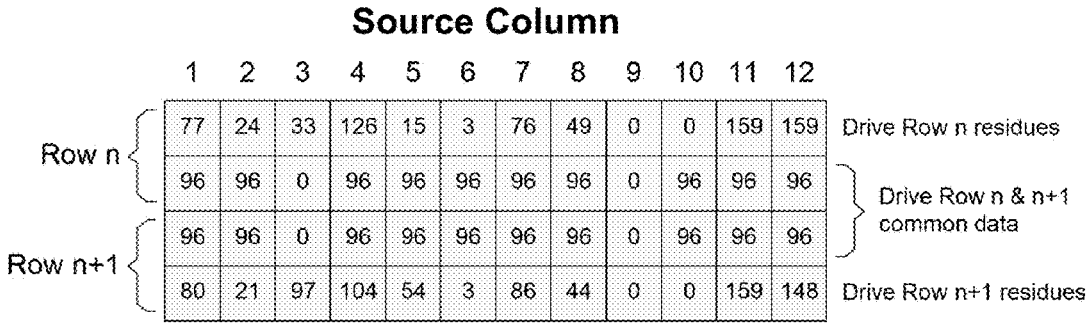
FIG. 13 depicts the calculated result of the common brightness data and residual data.

FIG. 13 shows the calculated result of the common brightness data and residual data. As the determined comparison value is 96, the two rows of zones 24 have a common brightness data 52B of 96. The first residual data 52A and the second residual data 52B are also calculated. The calculated result also demonstrates the case when one of the two brightness data of the same source column is smaller than the comparison value, the corresponding common brightness data 52B for that source column is set to zero. Hence, the two lines are driven separately without any overlapping region.

This illustrates the fundamental embodiments of the present disclosure for use in a display panel with an emphasis on controlling the LED backlight with local dimming. It will be apparent that variants of the above-disclosed and other features and functions, or alternatives thereof, may be combined into many other different systems or apparatuses. The present embodiment is, therefore, to be considered in all respects as illustrative and not restrictive. The scope of the disclosure is indicated by the appended claims rather than by the preceding description, and all changes that come within the meaning and range of equivalency of the claims are therefore intended to be embraced therein.

What is claimed is:

1. An apparatus for displaying images, comprising:

a display panel comprising plural pixels for displaying the images;

a light-emitting diode (LED) backlight divided into a plurality of zones arranged in a two-dimensional (2D) array of rows and columns; and a control unit configured to couple a compensated video data to the display panel and a dimming data to the LED backlight;

wherein:

the plurality of zones of the LED backlight is driven by row enable signals and column driving signals based on the dimming data;

an individual column driving signal is arranged to drive two rows of zones;

a first row enable signal for driving a first row of the two rows of zones comprises a first enable pulse in a frame period, and a second row enable signal for driving a second row of the two rows of zones comprises a second enable pulse in the frame period, wherein the first enable pulse and the second enable pulse are at least partially overlapped in time for reducing a pulse current of the LED backlight;

the first enable pulse comprises a first pulse width portion and an overlapping pulse width portion, the overlapping pulse width portion being a pulse width portion that the first and second enable pulses overlap in time;

the second enable pulse comprises a second pulse width portion and the overlapping pulse width portion;

the first row enable signal is formed by positioning the first pulse width portion immediately before the overlapping pulse width portion in time, and the second row enable signal is formed by positioning the second pulse width portion immediately after the overlapping pulse width portion in time, thereby allowing the first and second row enable signals to be independently configured to drive the two rows of zones with different brightness while enabling the lifetime of the LED backlight to be enhanced;

the first row is configured to be driven by a first LED driving current during the first pulse width portion and the second row is configured to be driven by the first LED driving current during the second pulse width portion;

the two rows of zones are configured to be simultaneously driven by a second LED driving current during the overlapping pulse width portion;

the second LED driving current is lower than the first LED driving current; and the two rows of zones are paired up for reducing the second LED driving current and configured to be driven without overlapping in time with other rows of zones.

2. The apparatus of claim 1, wherein:

the individual column driving signal transmits a common brightness data, a first residual brightness data and a second residual brightness data for driving the two rows of zones, the common brightness data is applied to the two rows of zones and is used for controlling a length of the overlapping pulse width portion;

the first residual brightness data is applied to the first row and is used for controlling a length of the first pulse width portion, whereby the first row emits light according to the first residual brightness data and the common brightness data; and the second residual brightness data is applied to the second row and is used for controlling a length of the second pulse width portion, whereby the second row emits light according to the second residual brightness data and the common brightness data.

3. The apparatus of claim 2, wherein the first row is adjacent to the second row.

4. The apparatus of claim 2, wherein the two rows of zones are enabled simultaneously according to the common brightness data during the overlapping pulse width portion.

5. The apparatus of claim 4, wherein the first row is enabled according to the first residual brightness data during the first pulse width portion of the first pulse width; and the second row is enabled according to the second residual brightness data during the second pulse width portion of the second pulse width.

6. The apparatus of claim 2, wherein the LED backlight is driven by an LED driver configured to receive the dimming data and couple the row enable signals and the column driving signals to the LED backlight.

7. The apparatus of claim 6, wherein the common brightness data is adaptively selected from a plurality of predetermined comparison values for determining an optimized value for the common brightness data to achieve a largest total brightness data on the overlapping pulse width portion across all the zones on the first row and the second row, wherein:

the overlapping pulse width portion, the first pulse width portion, and the second pulse width portion are defined adaptively by pulse width modulation based on the common brightness data, the first residual brightness data and the second residual brightness data; and the overlapping pulse width portion is switchable to zero for momentarily preventing driving the two rows of zones simultaneously.

8. The apparatus of claim 7, wherein the LED driver comprises a plurality of accumulator blocks each configured to perform data accumulation for a comparison value, thereby the comparison value achieving the largest total brightness data is determined.

9. The apparatus of claim 8, wherein an individual accumulator block comprises a comparator and an adder, wherein the comparator is configured to receive a common brightness factor from the column, and couple a value equivalent to the comparison value to the adder when the common brightness factor is larger than the comparison value.

10. The apparatus of claim 6, wherein the control unit is integrated into the LED driver or a display driver configured to drive the display panel.

11. The apparatus of claim 1, wherein the display panel is a liquid crystal display (LCD) panel.

12. The apparatus of claim 1, wherein the control unit is a local dimming bridge chip configured to receive a video data from an application processor.

13. A light-emitting diode (LED) backlight for a display panel, comprising:

plural LEDs arranged in a plurality of zones, wherein the plurality of zones is arranged in a two-dimensional (2D) array of rows and columns; and an LED driver configured to receive a dimming data from a control unit and couple row enable signals and column driving signals to drive the plurality of zones based on the dimming data;

wherein:

an individual column driving signal is arranged to drive two rows of zones;

a first row enable signal for driving a first row of the two rows of zones comprises a first enable pulse in a frame period, and a second row enable signal for driving a second row of the two rows of zones comprises a second enable pulse in the frame period, wherein the first enable pulse and the second enable pulse are at least partially overlapped in time for reducing a pulse current of the LED backlight;

the first enable pulse comprises a first pulse width portion and an overlapping pulse width portion, the overlapping pulse width portion being a pulse width portion that the first and second enable pulses overlap in time;

the second enable pulse comprises a second pulse width portion and the overlapping pulse width portion;

the first row enable signal is formed by positioning the first pulse width portion immediately before the overlapping pulse width portion in time, and the second row enable signal is formed by positioning the second pulse width portion immediately after the overlapping pulse width portion in time, thereby allowing the first and second row enable signals to be independently configured to drive the two rows of zones with different brightness while enabling the lifetime of the LED backlight to be enhanced;

the first row is configured to be driven by a first LED driving current during the first pulse width portion and the second row is configured to be driven by the first LED driving current during the second pulse width portion;

the two rows of zones are configured to be simultaneously driven by a second LED driving current during the overlapping pulse width portion;

the second LED driving current is lower than the first LED driving current; and the two rows of zones are paired up for reducing the second LED driving current and configured to be driven without overlapping in time with other rows of zones.

14. The LED backlight of claim 13, wherein:

the individual column driving signal transmits a common brightness data, a first residual brightness data and a second residual brightness data for driving the two rows of zones;

the common brightness data is applied to the two rows of zones and is used for controlling a length of the overlapping pulse width portion;

the first residual brightness data is applied to the first row and is used for controlling a length of the first pulse width portion, whereby the first row emits light according to the first residual brightness data and the common brightness data; and the second residual brightness data is applied to the second row and is used for controlling a length of the second pulse width portion, whereby the second row emits light according to the second residual brightness data and the common brightness data.

15. The LED backlight of claim 14, wherein the common brightness data is adaptively selected from a plurality of predetermined comparison values for identifying an optimized value for the common brightness data to achieve a largest total brightness data on the overlapping pulse width portion across all the zones on the first row and the second row, wherein:

the overlapping pulse width portion, the first pulse width portion, and the second pulse width portion are defined adaptively by pulse width modulation based on the common brightness data, the first residual brightness data and the second residual brightness data; and the overlapping pulse width portion is switchable to zero for momentarily preventing driving the two rows of zones simultaneously.

* * * * *